United States Patent [19]

Taylor et al.

[11] Patent Number: 4,928,583

[45] Date of Patent: May 29, 1990

[54] AIR FLOW CONTROL SYSTEM

[76] Inventors: Harry L. Taylor; Charles O. Ehret, both of 54 Buckley Meadows Dr., St. Louis, Mo. 63125

[21] Appl. No.: 222,956

[22] Filed: Jul. 22, 1988

[51] Int. Cl.[5] ..... F24F 11/02

[52] U.S. Cl. ..... 98/31.6; 98/1; 98/42.03; 98/42.15

[58] Field of Search ..... 98/1, 31.6, 42.03, 42.15, 98/42.19

[56] References Cited

U.S. PATENT DOCUMENTS

| | | | |
|---|---|---|---|
| 1,002,308 | 9/1911 | Powers | 98/42.03 X |
| 1,004,074 | 9/1911 | Powers | 98/42.03 X |
| 3,060,833 | 10/1962 | Pledger | 98/42.15 X |
| 3,665,838 | 5/1972 | Shepherd . | |
| 3,687,055 | 8/1972 | Dean, Jr. et al. | 98/40.16 |
| 3,785,272 | 1/1974 | McNabney et al. | 98/40.17 |
| 3,951,051 | 4/1976 | Dry | 98/42.15 |
| 4,017,026 | 4/1977 | Felter | 98/42.19 X |
| 4,397,233 | 8/1983 | Maxson | 98/41.2 X |
| 4,432,272 | 2/1984 | Becelaere | 98/1 |
| 4,545,363 | 10/1985 | Barchechat et al. | 126/285 B |
| 4,559,867 | 12/1985 | Van Bacelaere et al. | 98/1 |

*Primary Examiner*—Harold Joyce

[57] ABSTRACT

An air flow control system for controlling the air flow within a building having a blower for recirculating the air in the building is disclosed comprising vents for venting air out of the building and means for closing the vents upon the detection of fire, smoke, or high heat in the building. The system also includes sensors for detecting fire, smoke, or high heat in the building. A breaker switch connected to the blower is also included in the system for disabling the blower to stop recirculation of the air upon the detection of fire, smoke, and high heat in the building.

12 Claims, 2 Drawing Sheets

AIR FLOW CONTROL SYSTEM

BACKGROUND OF THE INVENTION

This invention relates to a system for controlling the air flow within a building and in particular to a system which detects smoke, fire, or high heat and automatically reduces the air flow within a building.

In the case of detecting smoke, fire, or high heat within a building it is desirble to cut off the flow of air within the entire building to prevent smoke from circulating, fire from burning, and to retard heat flow. Automatically closing fire dampers for air ducts are well known, examples of which are disclosed in the following U.S. patents: Dean, Jr. et al., U.S. Pat. No. 3,687,055; McNabney et al., U.S. Pat. No. 3,785,272; Maxson, U.S. Pat. No. 4,397,223; and Barchechat et al., U.S. Pat. No. 4,545,363. However, these automatic closable damper devices only operate in the room in which the fire occurs. Also, some of these prior art devices are only activated upon the melting of a fusible link which may not melt in time to prevent smoke from escaping through the air ducts to other parts of the building. Additionally, most buildings have a ventilation system, such as an air conditioner or a furnace, which includes a blower for circulating air in the building. If the blower is allowed to operate during, for example, a fire the circulated air will feed the fire. Therefore, in addition to closing the vents it is also advantageous to disable the blower.

SUMMARY OF THE INVENTION

Among the objects of the present invention is the provision of an air flow control system which is capable of automatically closing all the vents in a building and disabling the blower which recirculates air in the building to control the air flow within the building upon the detection of fire, smoke, or high heat in the building; the provision of such a system which is of simple construction for low cost and highly reliable operation; the provision of such a system that can be easily installed and incorporated into new buildings; the provision of such a system that can be easily installed in existing buildings; and the provision of such a system in which the vents and the blower can be easily and quickly reset.

The air flow control system of the present invention is adapted for use in a building having a blower for recirculating air in the building to control the air flow within the building upon the detection of fire, smoke, or high heat in the building. Generally, the air flow control system of the present invention comprises means for venting the air out of the building, means for detecting fire, smoke, or high heat in the building, means for closing the venting means upon the detection of fire, smoke, or high heat in the building connected to the detecting means, and means for disabling the blower to stop recirculation of the air upon the detection of fire, smoke, or high heat in the building connected to the detecting means.

According to the present invention, a vent is disclosed which comprises a cylindrical housing have an air inlet end and an air outlet end, and a circular damper blade positioned in the housing and operably connected to the housing for movement between an open position and a closed position. The vent also includes means for mounting the vent in the building.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
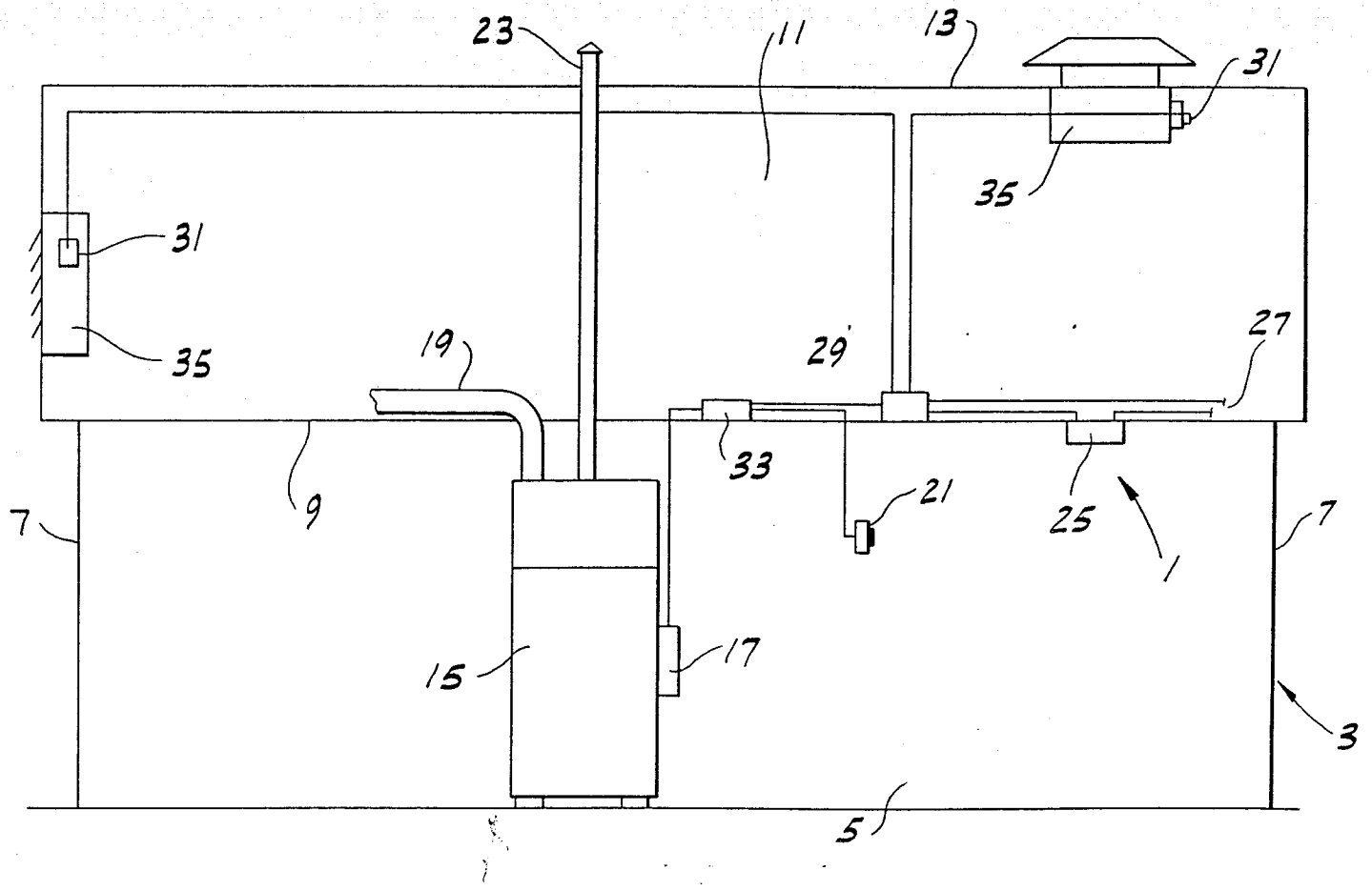
FIG. 1 is a schematic diagram of an air flow control system of the present invention.

The control system of the present invention, indicated generally as 1 in the figures, is shown as it would be installed in a building 3. It is to be understood that building 3 may be a residential building, a commercial building, or a multi-story building. Building 3 includes a living space 5 having a plurality of walls 7, a ceiling 9, an attic 11, and a roof 13. A furnace 15 having a blower motor 17 for circulating air through a duct 19 to various areas in the building 3 is controlled by a thermostat 21 and may also be included in the building. Furnace 15 also includes a furnace vent 23.

A sensor 25 which serves as means for detecting fire, smoke, or high heat is connected to a power source 27, such as a 110 V a.c. power source, and is mounted on the ceiling 9. Although sensor 25 is shown in this embodiment as a combination smoke, fire, or high heat sensor it is also possible to have individual sensors for detecting fire only or smoke or high heat. Additionally, there may be more than one sensor in the building. For example, there may be one sensor in each room of a building. Further, sensor 25 may be connected to a battery back-up power source (not shown) in the event of a power failure. Additionally, sensor 25 may be connected to an emergency warning system (not shown) which is directly wired to the fire department or a remote monitoring station for indicating a fire in the building. A transformer 29 is connected to sensor 25 and power source 27. Transformer 29 is also connected to a plurality of solenoids 31 and a breaker switch 33. Each solenoid 31 is mounted on an attic vent 35.

Figure 2:
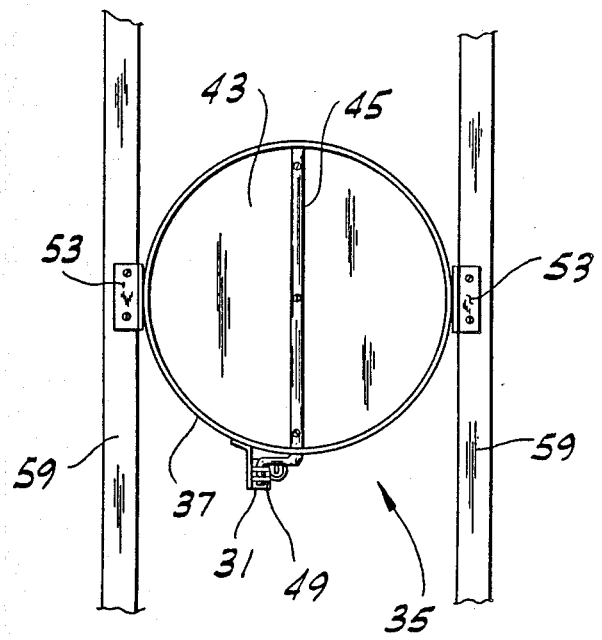
FIG. 2 is a top plan view of a vent of the air flow control system of the present invention.
Figure 3:
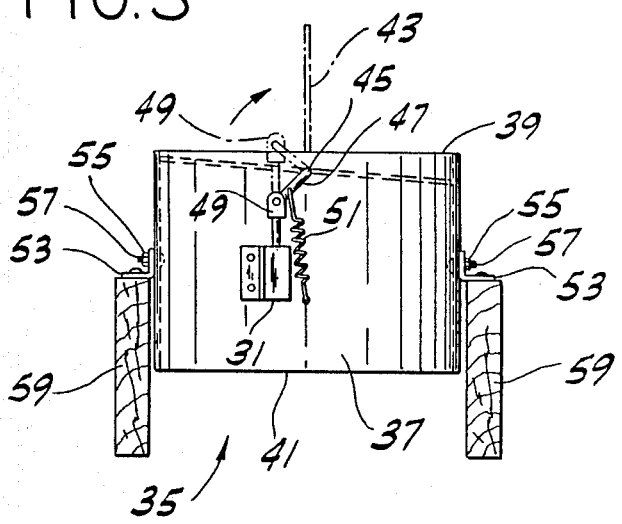
FIG. 3 is a side elevation view of the vent shown in FIG. 2 with the damper blade and its associated operating mechanism shown in the open position in phantom.

As shown in FIGS. 2 and 3, vent 35 includes a generally cylindrical housing 37 having an air inlet end 39 and an air outlet end 41. A circular damper blade 43 is positioned within housing 37 and connected to a driving link 45 for movement between an open position and a closed position. Driving link 45 extends outside housing 37 through an opening 47 to where it is connected to a plunger 49 of solenoid 31 and a spring 51. In the open position, blade 43 (shown in phantom in FIG. 3) extends out from the air inlet end 39 of housing 37 and plunger 49 moves against the bias of spring 51. In the closed position, the bias of spring 51 moves plunger 49 and driving link 45 towards solenoid 31 which causes blade 43 to cover air inlet end 39.

A pair of brackets 53 are connected to the housing 37 with nuts 55 and bolts 57 through elongated slots (not shown) to facilitate mounting vent 35 to rafters 59 which are typically spaced apart 16 inches on center. In some older buildings where the rafters may be spaced apart 24 inches on center a pair of angle irons (not shown) will be needed to mount the vent 35 to the angle irons which are in turn connected to the rafters.

Although not shown in the figures, some buildings have power vents which may be operated from a remote location. If this is the case, system 1 of the present invention may be connected to the vent by connecting a breaker switch, for example breaker switch 33, to the vent. Upon the detection of fire, smoke, or high heat, the breaker switch will close the damper blades of the power vent. Additionally, attic fans are installed in some buildings for removing hot air in the building and the attic. A breaker switch of system 1 may be connected to the attic fan to disable the fan upon the detection fire, smoke, or high heat.

The concept of this invention is that any vent or device which creates circulation of air in a building can be controlled to stop air circulation with the building upon the detection of fire, smoke, or high heat. If the air circulation can be cut off or at least significantly reduced, then the fire will burn itself out and smoke will not circulate. In operation, vents 35 are open, blower motor 17 is operating, and power source 27 is powering sensor 25 and transformer 29. In the event sensor 25 detects smoke, fire, or high heat transformer 29 will operate solenoids 31 to close vents 35 and breaker switch 33 to disable blower 17. Additionally, a reset switch can be included in the air flow control system to open the vents 35 and enable the blower 17 after the emergency. Further, included in duct 19 may be a plurality of vents (not shown) which may also be connected to and controlled by the air flow control system of the present invention. As can be appreciated the air flow within the building is now controlled and reduced to prevent the spreading of smoke and fire and to retard heat flow.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

We claim:

1. An air flow control system for controlling the air flow within a building having a blower for circulating the air in the building, the system comprising:

means for venting air out of the building;

means for detecting fire, smoke, or high heat in the building;

means for closing the venting means upon the detection of fire, smoke, or high heat in the building connected to the detecting means; and means for disabling the blower to stop recirculation of the air upon the detection of fire, smoke, or high heat in the building connected to the detection means.

2. The system of claim 1 wherein the venting means comprises a cylindrical housing having an air inlet end and an air outlet end, a circular damper blade positioned in the housing and operably connected to the housing and movable between an open and a closed position, means for moving the blade, and means for mounting the venting means in the building.

3. The system of claim 2 wherein the moving means comprises a driving link connected to the blade and extending out of the housing.

4. The system of claim 2 wherein the mounting means comprises brackets connected to the exterior of the housing.

5. The system of claim 1 wherein the closing means comprises a solenoid connected to the venting means and a transformer connected to the solenoid for operating the solenoid.

6. The system of claim 1 wherein the detecting means comprises a sensor.

7. The system of claim 1 wherein the disabling means comprises a breaker switch.

8. In combination with a building having a roof, a plurality of walls and rooms, one of the rooms having a blower for circulating the air in the building, and a plurality of closable vents in the rooms and the roof, an air flow control system for controlling the air flow within the building comprising:

means for detecting fire, smoke, or high heat in the building; and means for closing the vents upon the detection of fire, smoke, or high heat in the building connected to the detecting means.

9. The combination of claim 8 further comprising means for disabling the blower upon the detection of fire, smoke, or high heat in the building connected to the detecting means.

10. The combination of claim 8 wherein the detecting means comprises a sensor in each of the rooms.

11. The combination of claim 8 wherein the closing means comprises a solenoid connected to each of the vents and a transformer connected to the solenoid for operating the solenoid.

12. The combination of claim 9 wherein the disabling means comprises a breaker system.

* * * * *